US012636554B1

(12) United States Patent
Cleeves

(10) Patent No.: US 12,636,554 B1
(45) Date of Patent: May 26, 2026

(54) GOLF CLUB SHAFT EXTENSION SYSTEM

(71) Applicant: Frederick Cleeves, Phoenix, AZ (US)

(72) Inventor: Frederick Cleeves, Phoenix, AZ (US)

( * ) Notice: Subject to any disclaimer, the term of this patent is extended or adjusted under 35 U.S.C. 154(b) by 0 days.

(21) Appl. No.: 19/414,416

(22) Filed: Dec. 10, 2025

Related U.S. Application Data

(60) Provisional application No. 63/798,312, filed on May 1, 2025.

(51) Int. Cl.
*A63B 53/10* (2015.01)
*A63B 53/14* (2015.01)
*A63B 60/14* (2015.01)

(52) U.S. Cl.
CPC ..... *A63B 53/10* (2013.01); *A63B 53/14* (2013.01); *A63B 60/14* (2015.10); *A63B 2209/00* (2013.01)

(58) Field of Classification Search
CPC ..... A63B 53/00; A63B 53/10; A63B 53/12; A63B 53/14; A63B 60/22; A63B 60/28
See application file for complete search history.

(56) References Cited

U.S. PATENT DOCUMENTS 5,390,921 A * 2/1995 De Ruyter ..... A63B 60/22 473/299
5,558,326 A * 9/1996 Adamson ..... A63B 59/70 473/563
5,674,134 A * 10/1997 Blankenship ..... A63B 53/10 473/316
5,944,617 A * 8/1999 Falone ..... A63B 60/06 473/549
6,364,787 B1 * 4/2002 Huiskamp ..... A63B 60/22 473/297
2018/0304131 A1 * 10/2018 Sorenson ..... A63B 60/14

FOREIGN PATENT DOCUMENTS

FR 2934959 A1 * 2/2010 ..... A63B 60/14

OTHER PUBLICATIONS

Machine translation of FR2934959 (Year: 2010).*

* cited by examiner

*Primary Examiner* — Brian O Peters
(74) *Attorney, Agent, or Firm* — Bruce A. Lev

(57) ABSTRACT

A golf club shaft extension system including an extension plug having a tube portion with an adjustable grip portion thereon, wherein the tube portion is adapted to be placed within an opened grip end of a hollow shaft of a golf club to thereby extend the length of the shaft of the golf club, and a shrinkable grip sleeve formed from a flexible and heat-shrinkable material that is placed over the extension plug and existing grip of the golf club and heat shrunk to secure the extension plug in place upon the end of the golf club.

10 Claims, 11 Drawing Sheets

GOLF CLUB SHAFT EXTENSION SYSTEM

CROSS-REFERENCE TO RELATED APPLICATION

The present application is related to and claims priority from prior provisional application Ser. No. 63/798,312, filed May 1, 2025 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to golf clubs, and more specifically to extending the length of the shaft a golf club.

2. Description of the Related Art

Prior art golf clubs have a chosen length that is not extendable. For many reasons, a golf player may outgrow their golf club set and need clubs that are longer than the ones they have. Golf clubs and golf club sets are prohibitively expensive, and as such many players choose to simply play with inappropriately sized clubs which results in reduced performance. Others choose to spend the money each time they need an adjustment. Others choose to have their clubs professionally re-sized using expensive methods, including replacing the entire shaft of each club. Thus, a need exists for a golf club shaft extension system that is cheaper and adapted to be used by golfers themselves to avoid the above-mentioned problems.

BRIEF SUMMARY OF THE INVENTION

In view of the foregoing disadvantages inherent in the known types of golf club sets and systems, or the like in the prior art, the present invention provides a novel golf club shaft extension system. As such, the general purpose of the present invention, which will be described subsequently in greater detail, is to provide a golf club shaft extension system including an extension plug having a tube portion with an adjustable grip portion thereon, wherein the tube portion is adapted to be placed within an opened grip end of a hollow shaft of a golf club to thereby extend the length of the shaft of the golf club, and a shrinkable grip sleeve formed from a flexible and heat-shrinkable material that is placed over the extension plug and existing grip of the golf club and heat shrunk to secure the extension plug in place upon the end of the golf club, with all the advantages of the prior art and none of the disadvantages.

There has thus been outlined, rather broadly, the more important features of the invention in order that the detailed description thereof that follows may be better understood and in order that the present contribution to the art may be better appreciated. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a golf club shaft extension system, constructed and operative according to the teachings of the present invention.

The various embodiments of the present invention will hereinafter be described in conjunction with the appended drawings.

DETAILED DESCRIPTION

As discussed above, embodiments of the present invention relate to a golf club shaft extension system.

Figure 1:
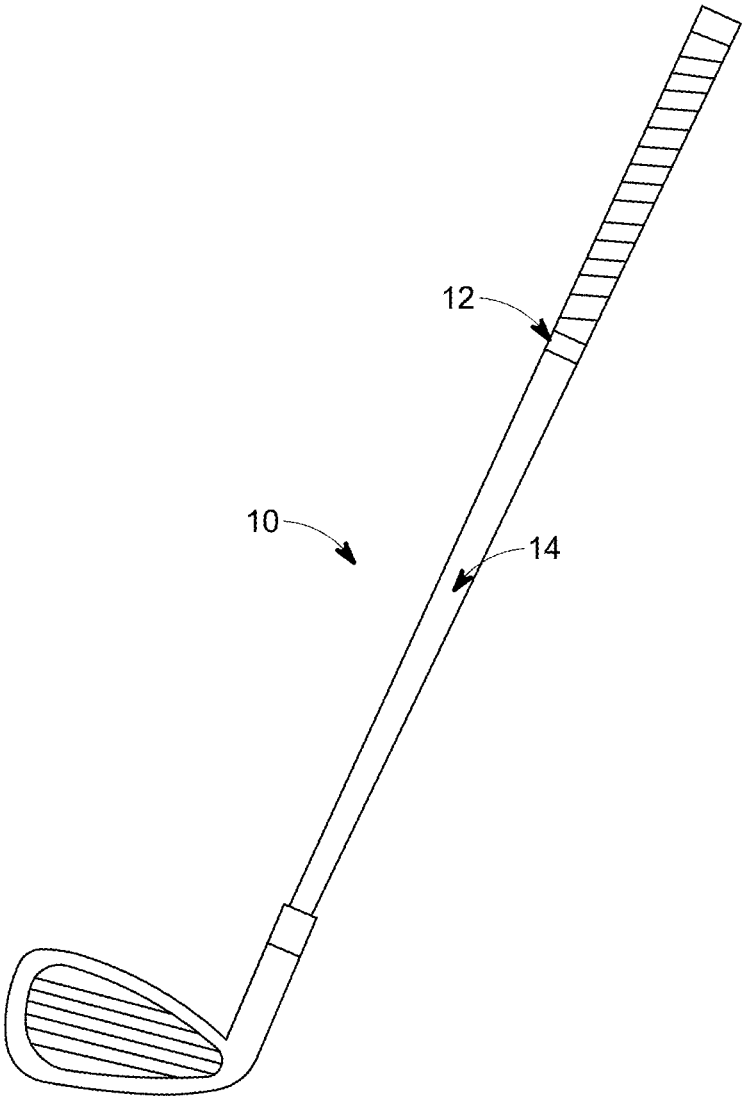
FIG. 1(PRIOR ART)
FIG. 1 shows a side view of a prior art golf club with a grip.
Figure 2:
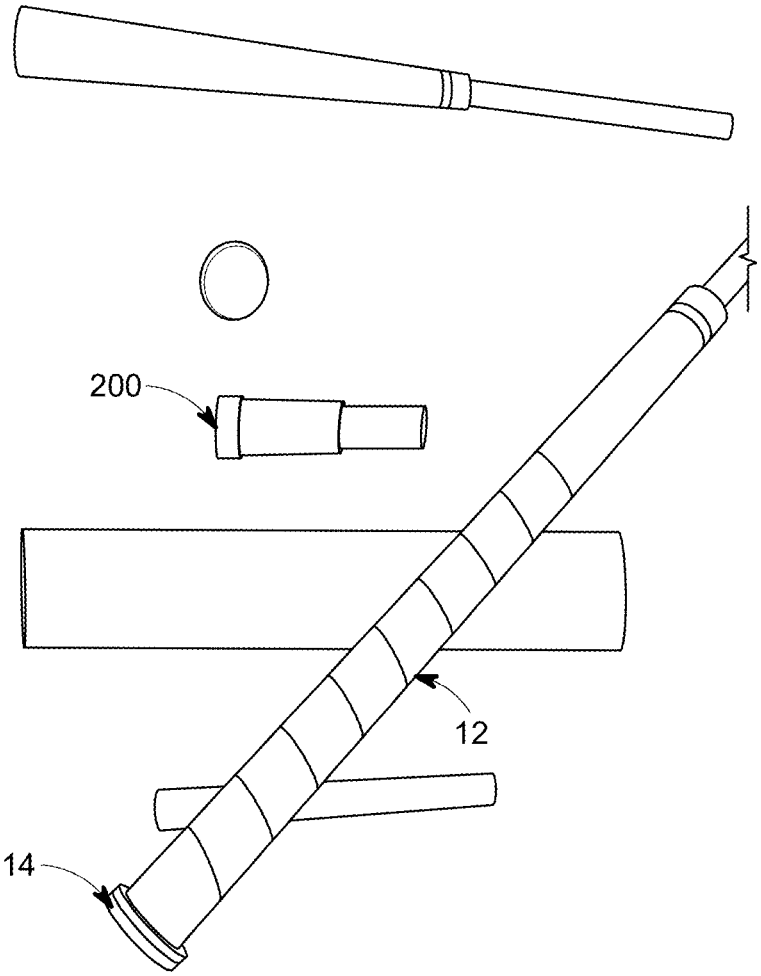
FIG. 2 shows a side view of the prior art golf club to be resized.
Figure 3:
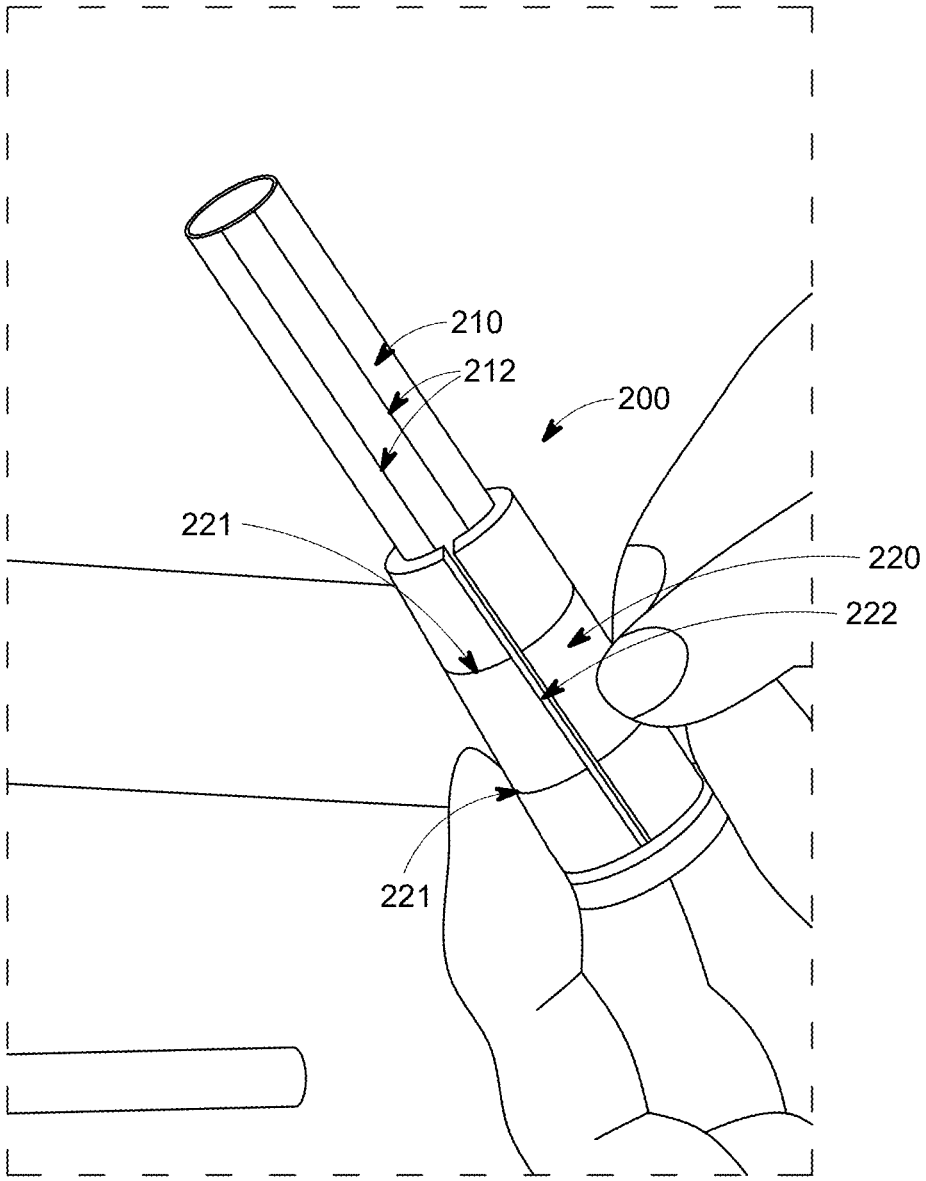
FIG. 3 shows a perspective view of the extension plug of the instant invention.

FIG. 1 shows a side view of a prior art golf club 10 with an existing grip 12.

As shown in FIGS. 2-11, The golf club shaft extension system includes an extension plug 200 having a tube portion 210 with an adjustable grip portion 220 thereon, wherein the tube portion 210 is adapted to be placed within the opened grip end 16 of the hollow shaft 14 of the golf club 10 to thereby extend the length of the shaft of the golf club, and a shrinkable grip sleeve 100 formed from a flexible and heat-shrinkable material that is placed over the extension plug 200 and a portion of an existing grip 12 of the golf club and heat shrunk to secure the extension plug in place upon the end of the golf club.

The tube portion 210 of extension plug 200 may include a series of spaced vertical grooves 212 therethrough adapting the tube portion to flex, fit, and be retained within the opened end of golf club shafts of varying diameters; and the adjustable grip portion 220 may include a vertical slit 222 therethrough adapting the grip portion such that when it is cut horizontally by a saw or knife, at a chosen location, ie, 221, it can be made smaller in length by peeling off the portion adjacent the tube portion 210, such that when placed within the opened grip end 16 of the hollow shaft 14 of the golf club 10, the resulting extension of the golf club extending outwardly from the opened grip end 16 is smaller in length, and as such, the grip portion 220, and thereby extension plug 200, is adjustable in length.

The tube portion 210 of extension plug 200 may be formed from a variety of materials, including plastic and metal, and the preferred length may be between 2 and 4 inches. The adjustable grip portion 220 may be formed from a variety of materials, including plastics and rubber, and the preferred length may be between 2 and 4 inches as well.

In use, a user cuts off the end of the shaft 14 and grip 12 of a golf club 10; then decides how much of the grip portion 220 to cut horizontally based upon their height and desired use; then, using a saw or knife, cut and peel off the chosen portion of the grip portion 220 adjacent the tube portion 210; then squeeze the tube portion 210 to make its diameter smaller via the vertical grooves 212 and push the extension plug 200 into the opened grip end 16 of the hollow shaft 14; then place the shrinkable grip sleeve 100 over the extension plug 200 and existing grip 12 of the golf club and heat shrink it using a heat source to thereby secure the extension plug 200 in place upon the end of the golf club 10.

Figure 4:
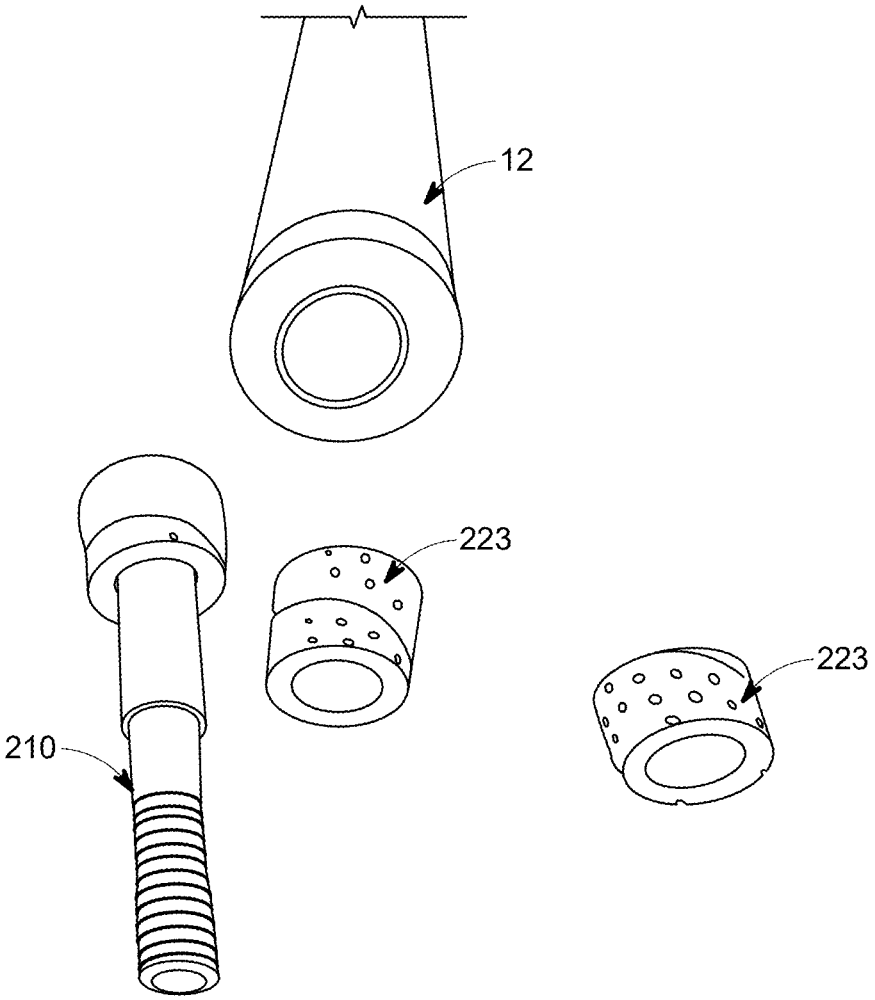
FIG. 4 shows a perspective view of an alternate embodiment of the extension plug of the instant invention about to be placed therein.
Figure 5:
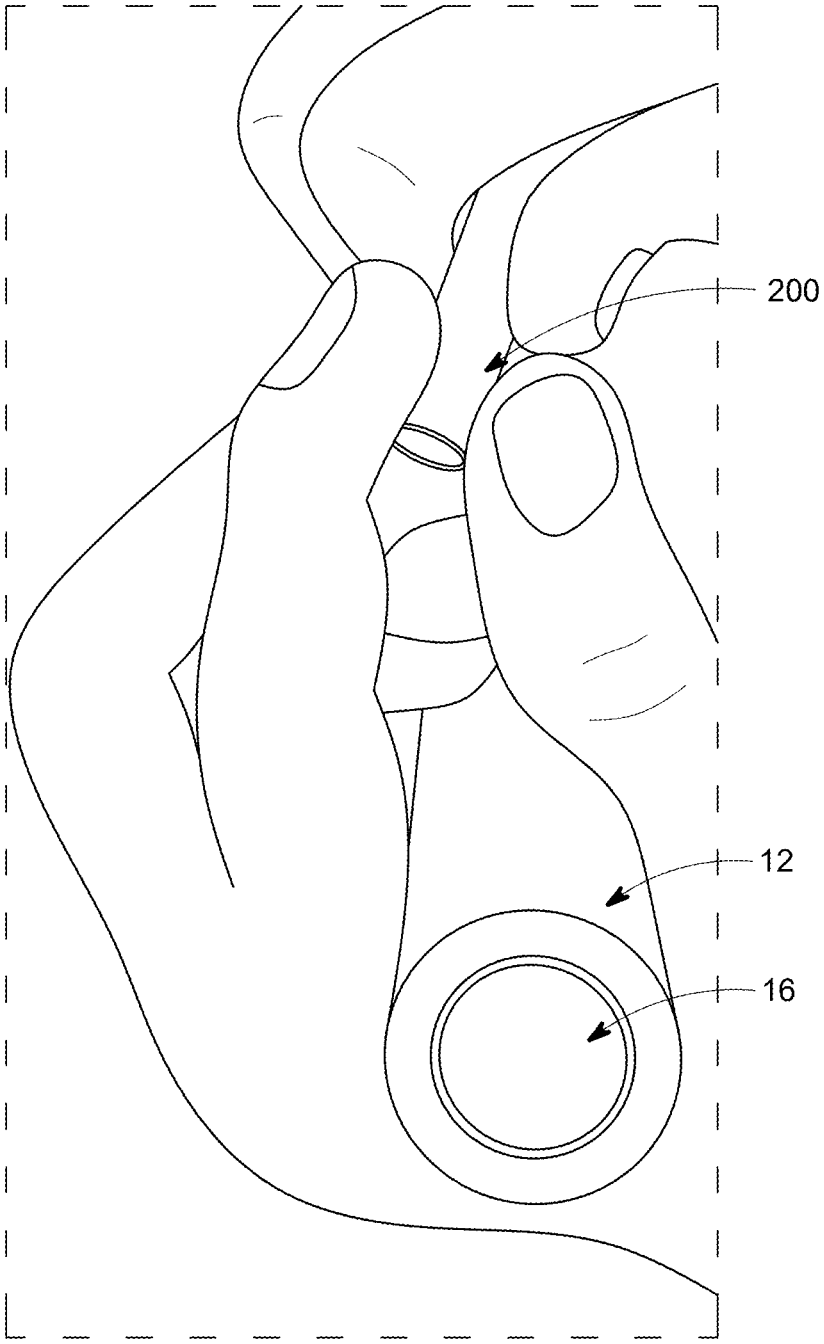
FIG. 5 shows a perspective view of the grip end of the prior art golf club cut open and the extension plug of the instant invention about to be placed therein.
Figure 6:
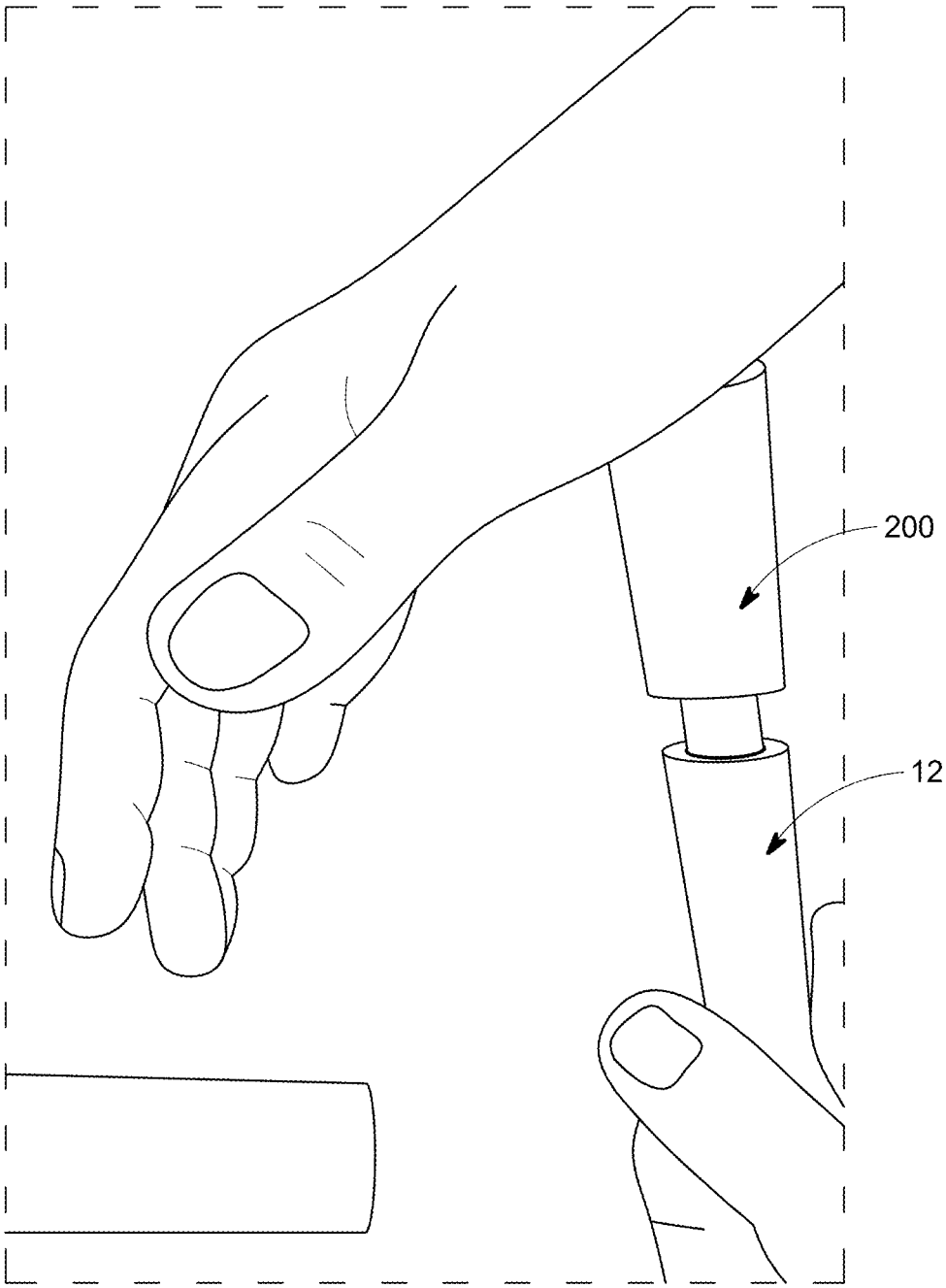
FIG. 6 shows a side view of the extension plug of the instant invention being pushed into the cut grip end of the prior art golf club.
Figure 7:
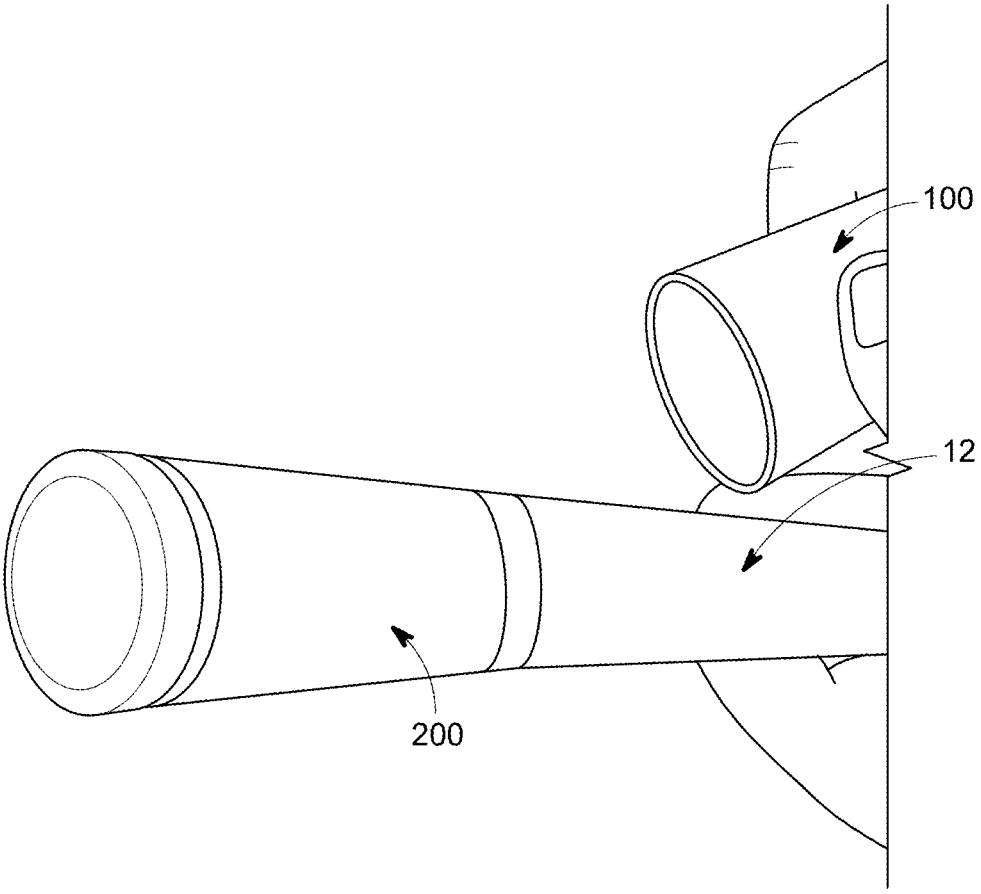
FIG. 7 shows a perspective view of the extension plug of the instant invention pushed into the cut grip end of the prior art golf club and a grip sleeve about to be placed over the extension plug and grip of the prior art golf club.
Figure 8:
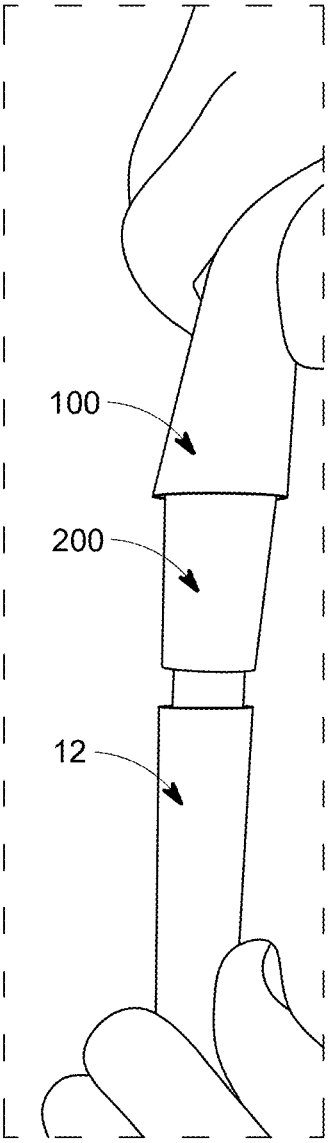
FIG. 8 shows a side view of the grip sleeve being placed over the extension plug and grip of the prior art golf club.
Figure 9:
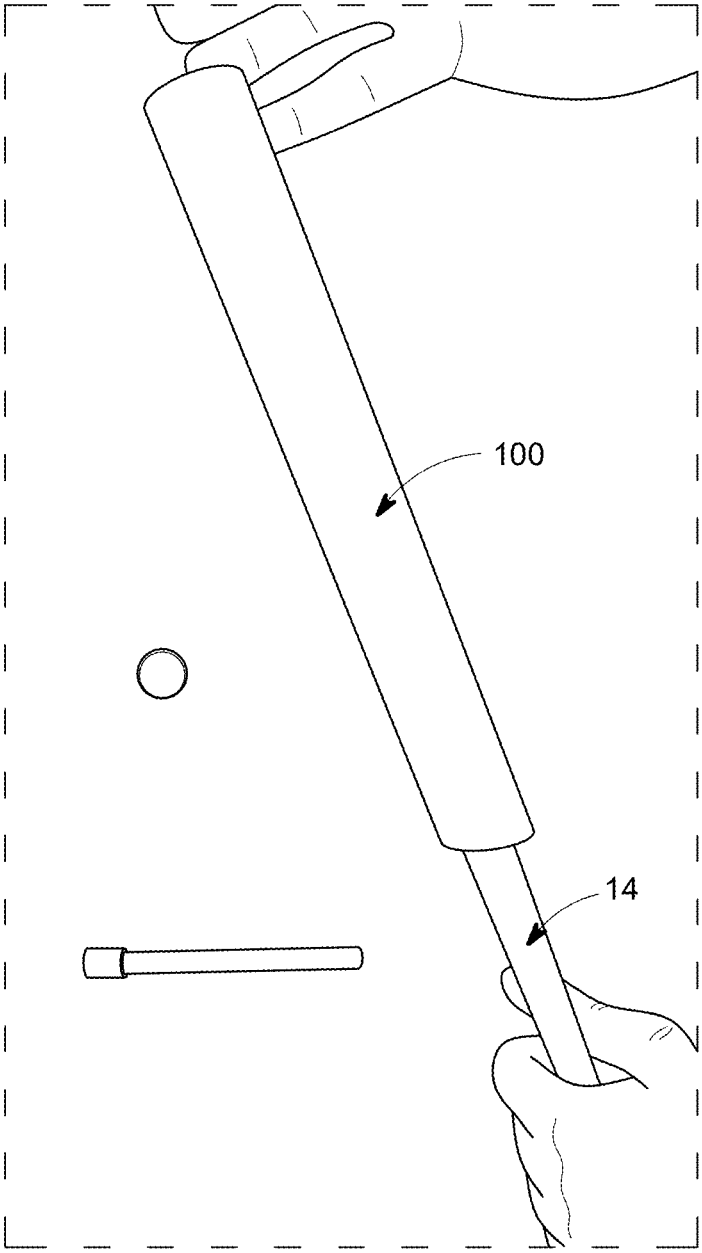
FIG. 9 shows a side view of the grip sleeve placed over the extension plug and grip of the prior art golf club.
Figure 10:
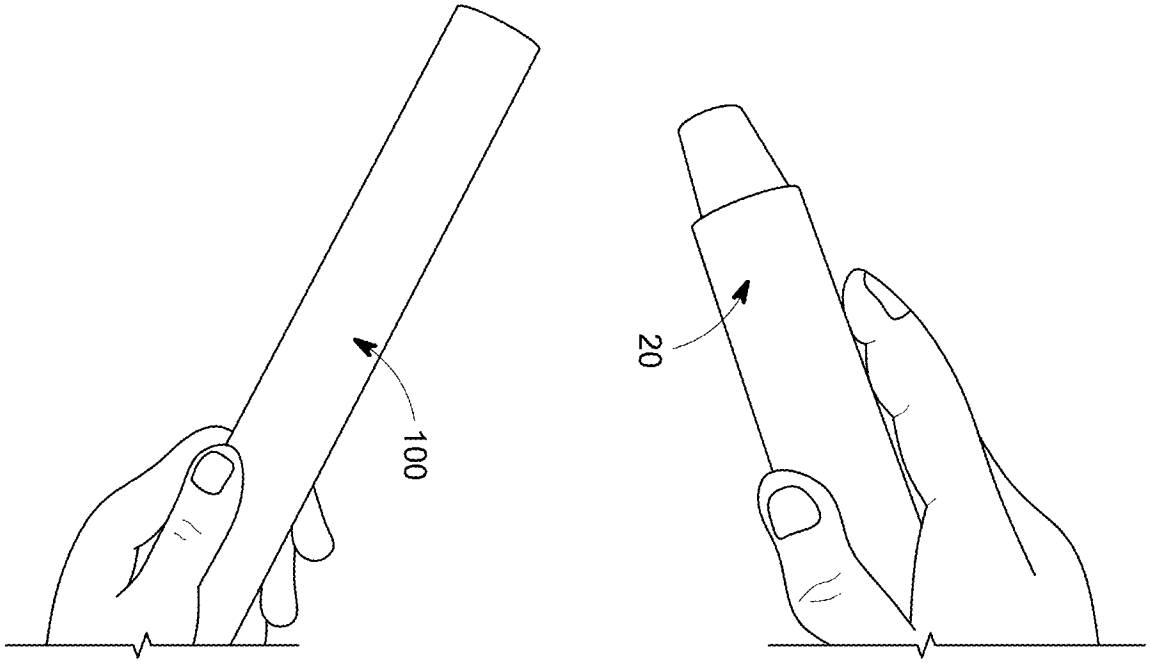
FIG. 10 shows a side view of the grip sleeve being heat shrunk over the extension plug and grip of the prior art golf club using a heat source.
Figure 11:
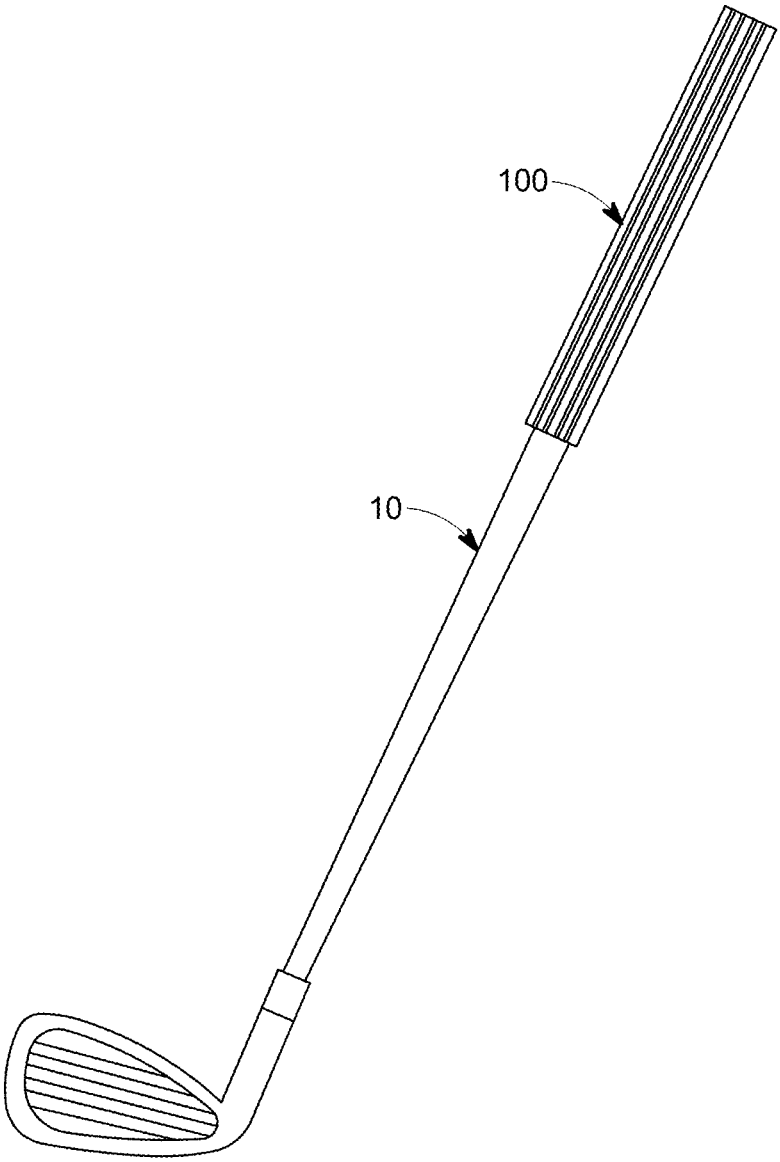
FIG. 11 shows a side view of the resized prior art golf club with the extension plug inserted therein and the grip sleeve heat shrunk over the extension plug and golf club grip end.

In an alternate embodiment, shown in FIG. 4, adjustable grip portion 220 may be formed from a plurality of pre-cut separate tubular pieces 223 adapted to be individually slid on and off tube portion 210 to adjust the length of extension of the golf club based upon a user's height and desired use. Furthermore, tube portion 210 may also include a series of ridges extending around its circumference and adapted to provide friction between extension plug 200 and the open shaft of the golf club when inserted to thereby hold the extension plug 200 in place while the grip sleeve 100 is placed upon the existing grip 12 and the extension plug 200. Furthermore, the pre-cut separate tubular pieces of tube portion 210 may be formed of a material having a predetermined resilience and frictional quality to interact with the material of the grip sleeve 100 to thereby hold the extension plug 200 in place while the grip sleeve 100 is placed upon the existing grip 12 and the extension plug 200. Furthermore, the pre-cut separate tubular pieces of tube portion 210 may be formed having differing lengths and weights, ie, 5 grams, 10 grams, 20 grams, and 50 grams, etc. Using weighted tubular pieces a user can counterweight their clubs and shift the club's balance point closer to their hands, which can reduce the feeling of head-heaviness, make the club feel easier to pivot, and increase perceived club head speed.

The instant invention can also be used to reduce the length of an existing golf club by cutting the club at a lower point along its shaft and capping it off with plug 200.

Referring now to the preferred embodiment in FIGS. 7-11, the shrinkable grip sleeve 100 is formed from a flexible and heat-shrinkable material having a tubular shape that is adapted to be placed over the existing grip 12 on the golf club 10 and the extension plug 200. In use, the grip sleeve 100 is placed over the existing grip 12 and the extension plug 200, and then a heat source, for example a heat wand 20, is used to shrink the grip sleeve 100 around and tightly upon the existing grip 12 and the extension plug 200 thereby securing the extension plug in place upon the end of the golf club and further forming a new and improved and/or enhanced grip for the golf club.

The grip sleeve 100 can be formed from a polyolefin compound, for example cross-linked polyolefin (XLPO), that is extruded to be used specifically as a shock absorbing and rubber-like shrinkable grip sleeve. The grip sleeve 100 can be produced in different colors, and with ridges and grooves set in repeating designs to be more consumer safe, more efficiently gripped, and uniquely attractive and personalized. Other chemical compounds and variations thereof can be mixed together to achieve different desired characteristics. Furthermore, ridges and grooves may be formed thereon that will not only increase the grip ability of the grip sleeve but also allow dirt and oils in a user's hand to migrate into the grooves keeping the ridges on the grip sleeve more grippable at all times while also making the grip sleeve easier to clean. The ridges and grooves can be formed in straight lines, or wavy lines, or curved lines, or any variation that can increase the friction between a user's hands and the grip. The grip sleeve 100 can also be turned inside-out (reversed) and shrunk onto an old grip for a smoother feel. Including a UV resistant additive can increase the useful life span of the grip sleeve over traditional grips. The grip sleeve 100 can also be printed upon for advertising or specialty applications.

In use, the grip sleeve 100 only needs a common heat source, such as a heat gun, a hair dryer, a heat wand 20, a toaster, a toaster oven, etc., to shrink the grip sleeve around the existing grip. Furthermore, a loose grip sleeve can easily be re-tightened at any time by applying additional heat to the sleeve. To cut the grip sleeve 100 to the length necessary or remove a grip sleeve the consumer needs only scissors. To make the grip sleeve adhere better, a spray adhesive can be applied to the existing grip before the new grip sleeve is shrunk into place.

In an alternate embodiment, the grip sleeve 100 can be formed of multiple layers of material having different properties, such that when heated the shrinking effect on each varies causing different effects upon the grip sleeve and the grip being covered. Further embodiments may include strands of differing material, such that when heated the shrinking effect between the strands and the main substrate varies causing different effects and enhancements upon the grip being covered while offering an external surface having ridges caused by the strands for increased friction between the user's hands and the grip sleeve outer surface.

When the alternate embodiment described above is in use, with the optional plurality of pre-cut separate tubular pieces, the method of using includes cutting off the top of the existing grip to expose the top of its shaft; then using a 4-5 inch long extension with a half inch grip size collar permanently attached at the top, sliding the extension into the exposed shaft. This will fit 6-foot to 6-foot 2-inch golfers; then choosing two or more pre-cut tubular pieces of one-half inch and one inch for addition length to fit taller golfers. These can be used to fit 6-foot to 6-foot 7-inch golfers. Before the extension is seated in the shaft it could also be epoxied for additional strength. Then the grip sleeve is slid over the old grip and the extension sized to the perfect length for the golfer and shrunk into place with heat and covering and securing the old grip and the new extension together in place. And as discussed above, the system can be used for shorter golfers simply by removing more of the existing shaft and grip to fit the perfect length for shorter golfers.

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

What is claimed is:

1. A golf club shaft extension system comprising: an extension plug including: a tube portion; and an adjustable grip portion; wherein said adjustable grip portion is located upon and surrounds said tube portion along a selected length thereof; wherein said tube portion is adapted to be pushed within an opened grip end of a hollow shaft of a golf club until said adjustable grip portion abuts said opened grip end, to thereby extend the length of said shaft of said golf club; and a shrinkable grip sleeve; wherein said shrinkable grip sleeve is formed from a flexible and heat-shrinkable material; and wherein said shrinkable grip sleeve is adapted to be slid over said extension plug and a portion of an existing grip of said golf club, and heat shrunk to secure said extension plug in place upon said opened grip end of said golf club; and wherein said adjustable grip portion includes a plurality of pre-cut separate tubular pieces adapted to be individually slid on and off said tube portion to thereby adjust the length of extension of said golf club based upon a user's height and desired use.

2. The golf club shaft extension system of claim 1, wherein said tube portion of said extension plug includes at least one vertical groove therethrough adapting the tube portion to flex, fit, and be retained within said opened grip end of golf club shafts of varying diameters.

3. The golf club shaft extension system of claim 1, wherein said adjustable grip portion includes at least one vertical slit therethrough adapting said grip portion such that when cut horizontally at a chosen location, it can be made smaller in length by peeling off a portion, such that when placed within said opened grip end of said hollow shaft of said golf club, the resulting extension of said golf club extending outwardly from said opened grip end is smaller in length, and as such, said grip portion, and thereby said extension plug, is adjustable in length.

4. The golf club shaft extension system of claim 1, wherein said plurality of pre-cut separate tubular pieces are formed having chosen lengths adapted to adjust the length of said extension plug and thereby the length of said golf club.

5. The golf club shaft extension system of claim 1, wherein said plurality of pre-cut separate tubular pieces are formed having chosen individual weights adapted to counterweight said golf club.

6. The golf club shaft extension system of claim 1, wherein said tube portion is formed from a material chosen from a list of materials consisting of plastic and metal.

7. The golf club shaft extension system of claim 1, wherein said adjustable grip portion is formed from a material chosen from a list of materials consisting of plastic and rubber.

8. The golf club shaft extension system of claim 1, wherein said shrinkable grip sleeve is formed from polyolefin.

9. The golf club shaft extension system of claim 8, wherein said polyolefin is formed as cross-linked polyolefin.

10. The golf club shaft extension system of claim 1, further comprising a heat source adapted and used to shrink said grip sleeve around and tightly upon said existing grip and said extension plug thereby securing said extension plug in place upon said opened grip end of said golf club.

* * * * *